US005425004A

United States Patent [19]

Staffan

[11] Patent Number: 5,425,004

[45] Date of Patent: Jun. 13, 1995

[54] TWO-WIRE ELECTRONIC MODULE FOR REMOTE DIGITAL CLOCKS

[75] Inventor: James G. Staffan, Middletown, Ohio

[73] Assignee: Industrial Electronic Service, Lebanon, Ohio

[21] Appl. No.: 207,288

[22] Filed: Mar. 7, 1994

[51] Int. Cl.[6] ..... G04C 11/00; G04B 9/00; G04B 1/00

[52] U.S. Cl. ..... 368/46; 368/66; 368/204

[58] Field of Search ..... 368/46, 48, 52, 64, 368/66, 203, 204, 155, 157, 201, 202

[56] References Cited

U.S. PATENT DOCUMENTS 3,608,301 9/1971 Loewengart ..... 368/66
3,643,420 2/1972 Haydon .
3,668,860 6/1972 Diersbock ..... 368/204
3,690,059 9/1972 Haydon .
3,811,265 5/1974 Cater .
4,404,624 9/1983 Yamazaki ..... 368/59
4,430,008 2/1984 Nishikubo ..... 368/202
4,490,050 12/1984 Singhi .
4,616,167 10/1986 Adler ..... 368/204

*Primary Examiner*—Vit W. Miska
*Attorney, Agent, or Firm*—Barbara Joan Haushalter

[57] ABSTRACT

An electronic system is used with one or more digital clocks. The electronic system comprises a two-wire module, attached to the digital clock, for allowing each digital clock to be run and reset to the correct time. A master clock controls a DC supply voltage applied to the two-wire module. The DC supply voltage keeps the digital clock in synchronization with the master clock. Interrupting the DC supply voltage and subsequently reapplying the DC supply voltage causes the two-wire module to set the digital clock to a predetermined time. Reversing polarity of the DC supply voltage for a calibrated time period electronically activates the two-wire module to reset the digital clock to the correct time.

7 Claims, 3 Drawing Sheets

TWO-WIRE ELECTRONIC MODULE FOR REMOTE DIGITAL CLOCKS

BACKGROUND OF THE INVENTION

The present invention relates to master/slave clock systems, and more particularly to an electronic module that allows a digital clock to be run and reset to the correct time of day on a two-wire system.

Many systems are in use for transmitting time information from a central station including a master clock to one or more peripheral stations including slave clocks. Master/slave clock systems are those in which a plurality of slave clocks are distributed throughout a given area, but are all controlled from a single master clock or controller. Typically, each slave clock has its own timing mechanism, but responds to the master clock for purposes of setting, synchronizing, and the like. Master/slave clock systems are useful in various applications such as schools, hospitals, or airports where a large number of clocks are distributed throughout the facility, and the master clock synchronizes all of the clocks so every clock tells the same time.

One type of master/slave clock system is generally characterized by transmitting a pulse once each minute from the master clock to the slave clocks. A disadvantage of this type of system is the requirement for manual resetting of the slave clocks when a power failure occurs for the master clock and its associated circuitry. In a large building having many slave clocks, such as a hotel, school, or certain office buildings, manual resetting of the slave clocks can be a problem.

In another type of these systems, the time indication at the master clock is transmitted via a multi-lead cable to the slave clocks. One of the leads is assigned to each of the digital values which are represented by the time indication. For a typical clock that displays hours and minutes, such an arrangement requires twenty-seven signal carrying leads between the master and slave clocks, which obviously results in high cost for both initial installation and future maintenance.

It will be appreciated that typically, the slave clocks are specially designed and configured to operate in the master/slave environment. There are, however, commercially available digital clocks, comparatively inexpensive, intended to run autonomously. One such type is a commonly known battery operated or electric digital clock. When power is interrupted, the clock resets to 12:00 and continues flashing until it is manually reset.

Many commercially available digital clocks include a power up initialization circuit which sets the clock to a predetermined time, such as 12:00, upon the initial application of power. In addition, such clocks often have fast set and slow set manual controls for adjusting the time, or setting the minute and hour on the clock. For example, upon activation of the slow set manual control, the time is advanced at a rate such as one minute per half second, while the fast set control typically operates at a quicker rate. Those controls are available to allow a user to set the time manually after application of power.

Currently, one common digital clock requires two wires to operate and an additional two wires to reset. It has only one reset mode which is at 12:00 am. Twice in every twenty-four hour period, at noon and at midnight, the master clock resets the digital clock to 12:00. Such a clock requires a battery and flashes when the battery runs down and power failure occurs. Extra expense is needed for additional cabling, battery, battery connectors, and mounting clips. Extra labor is involved in pulling of the additional cabling and battery replacement when required. The end user will also receive incorrect time for a period of up to twelve hours if the battery fails and power is interrupted.

Another common digital clock is connected by data transmission lines and run by local power. This digital clock requires special data transmission equipment and noise immune cabling. This special data transmission line is expensive and costly to install. Locating power outlets means the installation point of the digital clock is costly, especially in retrofit applications.

Another master/slave clock system is disclosed in U.S. Pat. No. 4,490,050. In the '050 patent, each slave clock of the master/slave clock system includes an unregulated dc supply adapted to be supplied with ac power from the master clock. Unfortunately, only a limited number of slave clocks can be included in the system without adding one or more additional power supplies.

It is seen then that there exists a need for an efficient and inexpensive means of allowing a digital clock to be run and reset quickly to the correct time of day.

SUMMARY OF THE INVENTION

This need is met by the device according to the present invention, wherein an electronic module allows a digital clock to be run and reset to the correct time of day on a two-wire system. The two-wire module is attached electronically to a digital clock, giving it the ability to be connected as part of many of the same digital clocks, each with its own module, in an electronic clock system.

In accordance with one aspect of the present invention, an electronic system is used with one or more digital clocks. The electronic system comprises a two-wire module, attached to each digital clock, for allowing each digital clock to be run and reset to the correct time. A master clock controls a DC supply voltage applied to the two-wire module. The DC supply voltage keeps the digital clock in synchronization with the master clock. Interrupting the DC supply voltage and subsequently reapplying the DC supply voltage causes the two-wire module to set the digital clock to a predetermined time. Reversing polarity of the DC supply voltage for a calibrated time period, which time period is determined by the master clock, electronically activates the two-wire module to reset the digital clock to the correct time.

Accordingly, it is an object of the present invention to provide an electronic control module for remote digital clocks which overcomes the problems associated with the prior art. It is an advantage of the present invention that the electronic control module provides an economical solution to the earlier stated problems. The present invention allows a specific digital clock to run and be reset off of standard two-conductor wiring. No remote end power is required, nor are batteries or battery clips required. The digital clock system can be installed into a new construction project, or retrofitted into an existing two-wire system. The module of the present invention allows the clock to be reset at any time of day, for example, daylight savings time or after a power outage. The digital clock can also be reset to 12:00.

Other objects and advantages of the invention will be apparent from the following description, the accompanying drawings and the appended claims.

DETAILED DESCRIPTION OF THE PREFERRED EMBODIMENTS

In accordance with the present invention, a master clock controls digital clocks which contain the two-wire module. A DC supply voltage applied to the two wires and controlled by a master clock, keep all the connected two-wire digital clocks in synchronization with the master clock. Interrupting the DC supply voltage and reapplying the DC supply voltage will cause the two-wire module to set the digital clocks to 12:00 am. Reversing the DC voltage supply polarity for a calibrated amount of time, for example done by the master clock after a power failure, electronically activates the two-wire module and steps the digital clock at two minutes per second, resetting all the clocks to the correct time of day, within one minute of the master clock. At midnight and at noon, the digital clocks will all be reset to 12:00 by the master clock, thus bringing them back to exactly the same time as the master clock.

Figure 1:
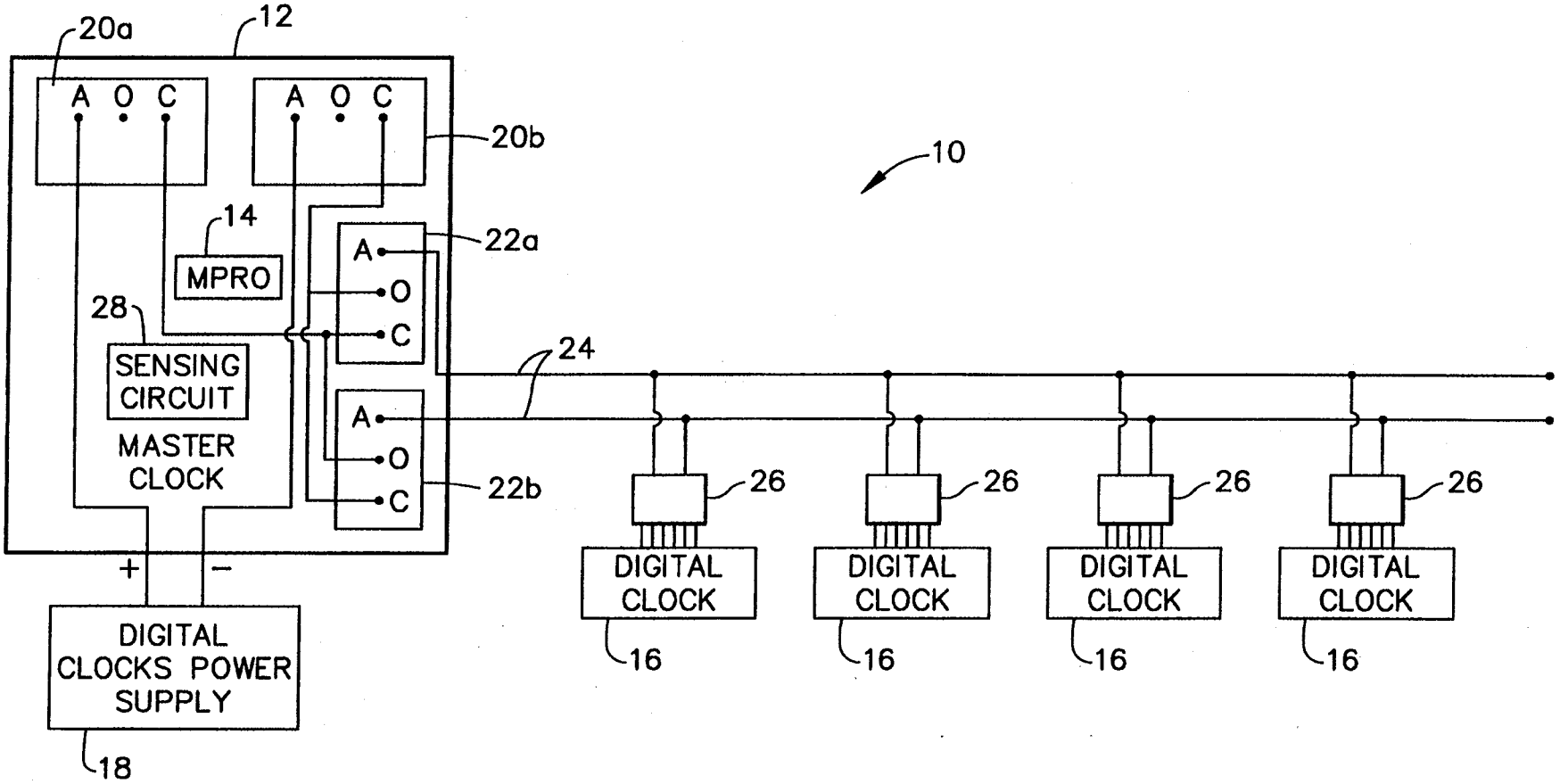
FIG. 1 is a schematic diagram illustrating a master clock system for controlling remote digital clocks with a two-wire module according to the present invention.

Referring now to the drawings, in FIG. 1 there is illustrated a system 10 including a master clock 12, such as a Standard Electric Time Model No. 1400 or 1402, manufactured by Faraday, which keeps accurate time of day, and accurate day of week, month, and year. The correct information is programmed into the master clock memory at the time of installation to allow the master clock to serve as a time and date keeping device. The master clock 12 includes a microprocessor 14 which continually reviews factory programmed firmware, allowing the master clock hardware to function and control equipment connected thereto.

In accordance with the present invention, the master clock 12 controls one or more remote digital clocks 16 by controlling the correct DC supply voltage and/or polarity from power supply 18 applied through relay contacts 20*a*, 20*b*, 22*a*, and 22*b* onto a two-wire system 24 connected to a two-wire module 26 associated with each clock 16. The relay contacts 20*a*, 20*b*, 22*a*, and 22*b* each include an A, representing armature; an 0, representing open; and a C, representing closed. The two-wire concept of the present invention can be applied to any master/slave clock system, and is particularly adaptable for use with the Faraday Model 2362 and the Faraday Model 2364, 2½" and 4" display, digital clocks. Any suitable electronic attachment can be used to attach the two-wire module 26 to the two-wire system 24.

Continuing with FIG. 1, the master clock relays 20*a*, 20*b*, 22*a*, and 22*b* remain in a normally closed position to allow DC voltage to flow to the digital clocks 16 through the two-wire system 24. In normal operation, the relays 20*a*, 20*b*, 22*a*, and 22*b* are to be activated at specific times to bring the remote digital clocks to the correct time of day in accordance with that displayed by the master clock 12. For example, at 12:00 a.m. and 12:00 p.m. the master clock 12 opens its run relays 20*a* and 20*b* for a predetermined time period and then returns those relays to a closed position. This interrupts the DC supply voltage 18 being applied to the two-wire module 26 before re-applying the DC supply voltage 18. This, then, causes the remote digital clocks 16 to reset to 12:00.

In accordance with a preferred embodiment of the present invention, the master clock 12 contains a sensing circuit 28 which is capable of recognizing power failure. When power returns to the system 10 after a power failure, the master clock 12 senses that there has been a power failure and initiates a procedure to reset the remote digital clocks 16. The master clock 12 calculates the time necessary to reset from 12:00 a.m. to the correct present time displayed by the master clock, for example, at a clock advance rate of two minutes per second. The master clock 12 then activates reset relays 22*a* and 22*b*. The reset relays 22*a* and 22*b* when activated, reverse the polarity of the DC supply voltage 18 which activates reset electronics, described in more detail with reference to FIG. 3, in the two-wire module 26 and operates a slow reset mode of the remote digital clocks 16 at the predetermined slow reset rate, for example, a rate of two minutes on the remote digital clock stepped for every one second of polarity reversal. When the calculated time of polarity reversal is concluded, the reset relays 22*a* and 22*b* are deactivated and the DC supply voltage 18 resumes its normal state. Each remote digital clock 16 runs on its own until the next reset activation occurs.

Figure 2:
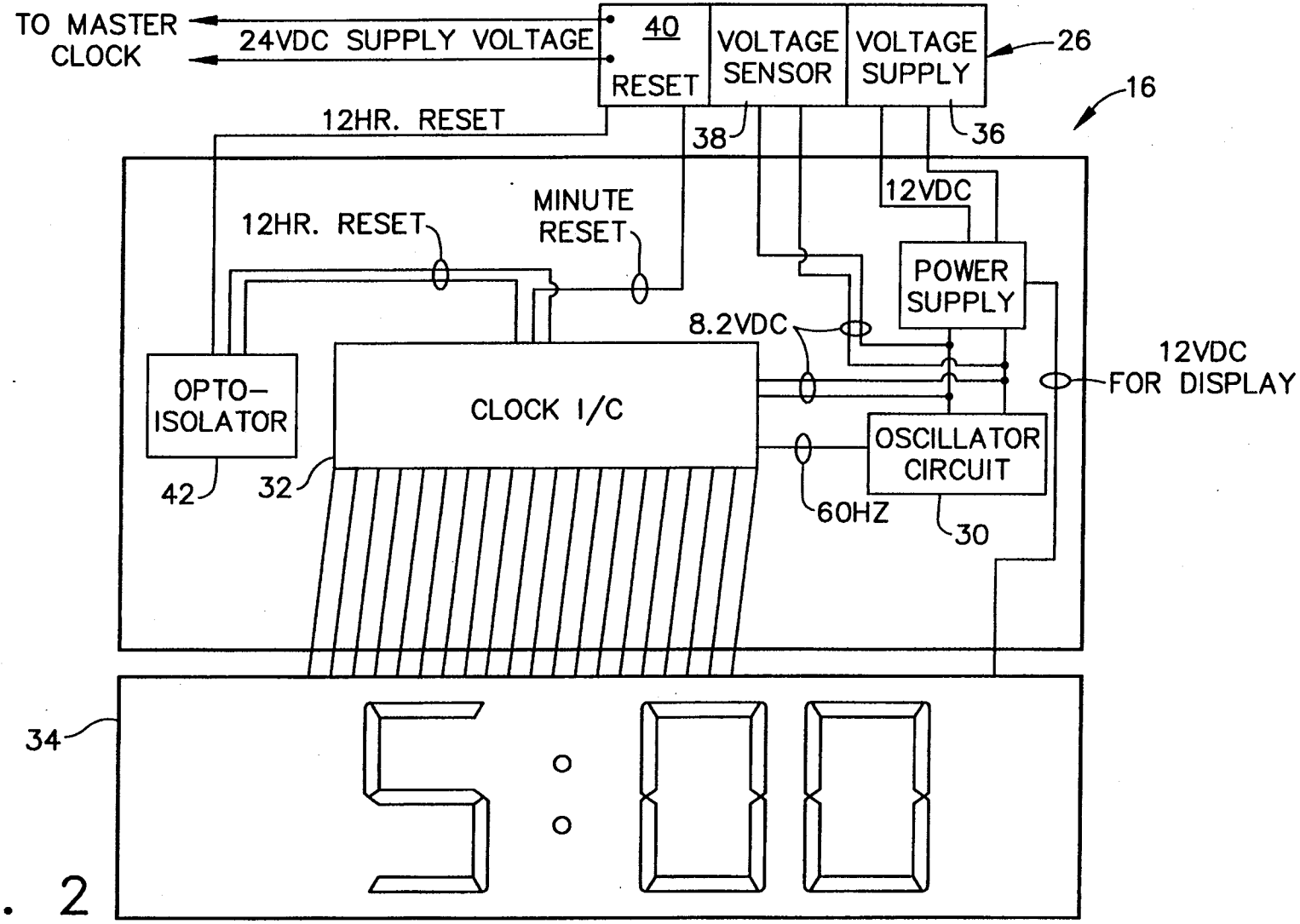
FIG. 2 is a schematic block diagram of the remote digital clock operation.

Referring now to FIG. 2 and continuing with FIG. 1, the remote digital clock 16 runs and keeps accurate time off of the DC voltage supplied by the power supply 18. The remote digital clock 16 comprises means for counting time by applying DC voltage to an oscillator circuit 30. The oscillator circuit 30 comprises a frequency generator (not shown) which sends a 60 Hz wave form to integrated circuit 32, of the clock 16 which counts input frequency and converts input frequency to displayable form for LED display 34. The integrated circuit may be any suitable commercially available circuit, including a digital alarm clock circuit such as a Texas Instruments TMS 1943 N2L.

The module 26 associated with the digital clock 16 comprises a voltage supply 36, a voltage sensor 38, and a reset mechanism 40. Since the digital clocks require only DC voltage to run, the module 26 passes DC voltage from voltage supply 36 to the remote digital clock 16 at a regulated and reduced operating level of twelve VDC. This allows the remote digital clock 16 to maintain and display the correct time of day at LED display 34. DC voltage is also required to power the LED display 34 through integrated circuit 32 of the clock 16.

In accordance with a preferred embodiment of the present invention, the two-wire module 26 of the present invention also electronically resets, via reset mechanism 40, the digital clock 16 every twelve hours through an optoisolator 42 which is connected to reset pins of integrated circuit 32. The module 26 resets the digital clock minutes directly, by electronic means, to the digital clock integrated circuit 32.

Figure 3:
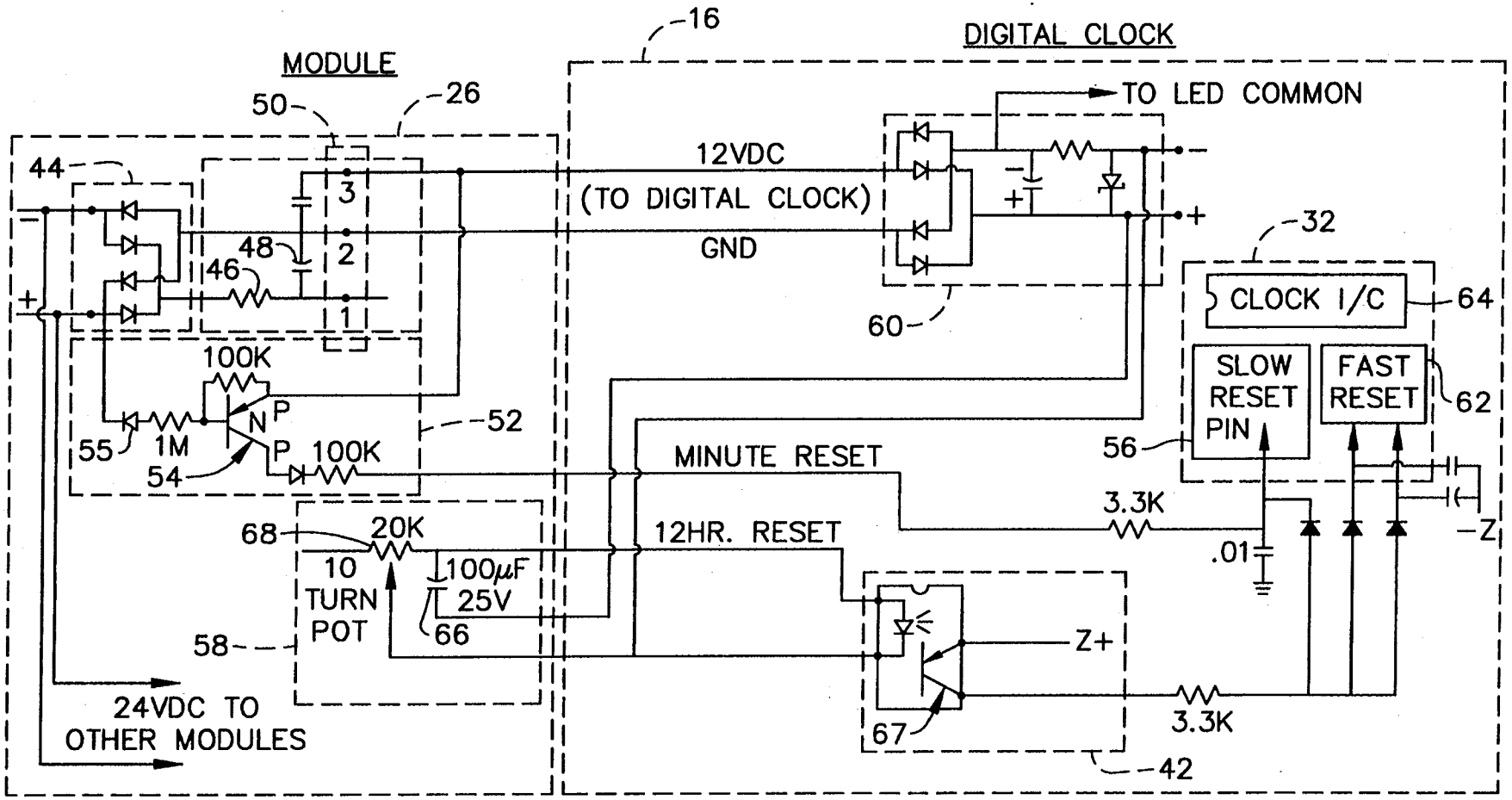
FIG. 3 is a schematic illustration of the connection between the two-wire module of the present invention and the digital clock.

Referring now to FIG. 3, the two-wire module 26 according to the present invention contains circuitry capable of operating the digital clock 16 off of a twenty-four VDC supply voltage, resetting the digital clock to 12:00 a.m., and slow stepping the digital clock. According to a preferred embodiment of the present invention, as illustrated in FIG. 3, there are six connections between each two-wire module 26 and its associated digital clock 16.

The twenty-four VDC supply voltage is applied to the module 26 and passes through a one amp full wave bridge 44 which outputs one polarity of dc voltage regardless of its input voltage polarity. The twenty-four VDC supply voltage is then reduced, filtered, and regulated by resistor 46, capacitor 48, and twelve VDC regulator chip 50. In a preferred embodiment, resistor 46 is a 39Ω resistor, capacitor 48 has a value of 470 μFarads, and regulator chip 50 is any suitable chip such as a 7812. The output from the twelve VDC regulator chip 50 supplies voltage to the digital clock 16 to operate independent of the master clock 12. The twenty-four VDC supply voltage is monitored on the input side of the full wave bridge 44, as illustrated in FIG. 3, by a diode and transistor combination circuit 52, which comprises the reset electronics. This diode-transistor combination circuit 52 acts as a switch, when the polarity of the twenty-four VDC voltage supply changes, monitoring the voltage polarity. Consequently, as long as the sensing side of the input voltage stays positive, the diode and transistor combination circuit 52 stays off. When the sensing side of the input voltage changes to negative, current flows through diode 55 and forward biases transistor 54 of the combination circuit 52. This allows current to flow from the emitter of transistor 54 to the collector and through a diode associated with the collector to slow reset pin 56 of integrated circuit 32 of the clock 16.

Upon power failure, there is a capacitor and resistor network 58, which is a non-oscillating RC circuit, for monitoring the interruption of power. The RC network 58 discharges through optoisolator 42 of the digital clock 16 to the clock power supply negative. This capacitor-resistor network 58 is connected to regulated circuitry 60 of the digital clock 16. When power is reapplied to the digital clock, the capacitor-resistor network 58 charges up and discharges causing the optoisolator 42 to pass enough current to switch on DC voltage for a short period of time to the reset pins 56 and 62 on integrated circuit 32 of the clock 16. This then allows all the intended time keeping electronics in integrated circuit 64 of the digital clock 16 to reset to 12:00:00 after the DC voltage is discharged.

According to a preferred embodiment of the present invention, in order to allow 12:00:00 reset to occur, DC voltage is required to be applied to the integrated circuit reset pin of the digital clocks, and then released. When power is reapplied, capacitor 66 of RC circuit 58 goes high to drive optoisolator 42 high, forward biasing transistor 67 associated with optoisolator 42 to drive pins 56 and 62 high until capacitor 66 reaches its cutoff point. At that time, capacitor 66 will discharge and remain idle. The RC circuit 58 also comprises a resistor 68, which is preferably a ten-turn 20K potentiometer.

Having described the invention in detail and by reference to the preferred embodiment thereof, it will be apparent that other modifications and variations are possible without departing from the scope of the invention defined in the appended claims.

What is claimed is:

1. An electronic system for use with at least one digital clock, the electronic system comprising:
   - a two-wire module associated with the at least one digital clock for allowing the at least one digital clock to be run and reset to correct time;
   - a switching mechanism for controlling a DC supply voltage applied to the two-wire module;
   - a power supply for supplying power to the electronic system;
   - a set and reset mechanism wherein interrupting the DC supply voltage and subsequently reapplying the DC supply voltage causes the two-wire module to set the at least one digital clock to a predetermined time; and
   - a reverse mechanism wherein reversing polarity of the DC supply voltage for a calibrated time period electronically activates the two-wire module to reset the at least one digital clock to correct time.

2. An electronic system as claimed in claim 1 further comprising a two-wire system connected to the two-wire module associated with the at least one digital clock.

3. An electronic system as claimed in claim 1 wherein the switching mechanism comprises a master clock.

4. An electronic system as claimed in claim 3 wherein the DC supply voltage maintains the at least one digital clock in synchronization with the master clock.

5. A method of operating at least one digital clock, the method comprising the steps of:
   - providing a two-wire module associated with each of the at least one digital clock for allowing the at least one digital clock to be run and reset to correct time;
   - applying a DC supply voltage to the two-wire module;
   - using a switching mechanism to control the DC supply voltage and for sensing power failure;
   - providing a power supply for supplying power to the at least one digital clock
   - providing a reset mechanism for resetting the at least one digital clock after the switching mechanism senses a power failure, the reset mechanism comprising reset relays for reversing polarity of the DC supply voltage.

6. A method as claimed in claim 5 further comprising the step of connecting a two-wire system to the two-wire module.

7. A method as claimed in claim 5 wherein the at least one digital clock operates autonomously of a master clock.

* * * * *